US011408604B2

(12) United States Patent
He et al.

(10) Patent No.: US 11,408,604 B2
(45) Date of Patent: Aug. 9, 2022

(54) LED LAMP WITH OMNIDIRECTIONAL HEAT DISSIPATION

(71) Applicants: Shanghai Sansi Electronic Engineering Co. Ltd., Shanghai (CN); Shanghai Sansi Technology Co. Ltd., Shanghai (CN); Jiashan Sansi Optoelectronic Technology Co. Ltd., Jiaxing (CN); Pujiang Sansi Optoelectronic Technology Co. Ltd., Jinhua (CN)

(72) Inventors: Xiaoliang He, Shanghai (CN); Guoli Zhu, Shanghai (CN); Shan Li, Shanghai (CN); Miaohuan Su, Shanghai (CN); Xiaobai Li, Shanghai (CN)

(73) Assignees: Shanghai Sansi Electronic Engineering Co. Ltd., Shanghai (CN); Shanghai Sansi Technology Co. Ltd., Shanghai (CN); Jiashan Sansi Optoelectronic Technology Co. Ltd., Jiaxing (CN); Pujiang Sansi Optoelectronic Technology Co. Ltd., Jinhua (CN)

( * ) Notice: Subject to any disclaimer, the term of this patent is extended or adjusted under 35 U.S.C. 154(b) by 0 days.

(21) Appl. No.: 17/352,389

(22) Filed: Jun. 21, 2021

(65) Prior Publication Data

US 2022/0065434 A1 Mar. 3, 2022

(30) Foreign Application Priority Data

Aug. 25, 2020 (CN) ..... 202010865304.X
Aug. 25, 2020 (CN) ..... 202021794844.5

(51) Int. Cl.

| | |
|---|---|
| ***F21K 9/232*** | (2016.01) |
| ***F21Y 115/10*** | (2016.01) |
| ***F21V 29/70*** | (2015.01) |
| ***F21V 29/85*** | (2015.01) |
| ***F21V 17/16*** | (2006.01) |

(52) U.S. Cl.

CPC ..... *F21V 29/70* (2015.01); *F21K 9/232* (2016.08); *F21V 17/16* (2013.01); *F21V 29/86* (2015.01); *F21Y 2115/10* (2016.08)

(58) Field of Classification Search

CPC ..... F21K 9/232

See application file for complete search history.

(56) References Cited

U.S. PATENT DOCUMENTS

2010/0026185 A1* 2/2010 Betsuda ..... F21V 29/67 315/32
2011/0204779 A1* 8/2011 Shum ..... H05K 1/189 315/35

(Continued)

OTHER PUBLICATIONS

Amazon.com, SANSI 22W (200-250 Watt Equivalent) A21 Ceramic LED Light Bulbs, ETL Listed, Daylight 5000K, Bright 3000lm, E26 Base, Non-dimmable, 2-Pack, 2017, Amazon.com, (Year: 2017).*

(Continued)

*Primary Examiner* — Eric T Eide

(57) ABSTRACT

The present disclosure proposes an LED lamp with omnidirectional heat dissipation, which includes an LED lamp housing including a power supply component inside, and a heat sink supporting an LED chip. The LED lamp housing and the heat sink are separated by a heat insulation member to block thermal influence between each other. The LED lamp of the present disclosure adds a heat insulation plate between the LED lamp housing for placing the power supply component and the heat sink, to block and weaken the mutual influence between the heat generated by the LED chip and the heat generated by the power supply component. The design improves the problem of excessively high ambi- (Continued)

ent temperature inside the power supply cavity of the traditional LED lamps, effectively avoids damage to the power supply device due to long-term working in a high-temperature environment, and improves the service life of the LED lamp.

8 Claims, 4 Drawing Sheets

(56) References Cited

U.S. PATENT DOCUMENTS

| | | | | |
|---|---|---|---|---|
| 2012/0307491 | A1* | 12/2012 | Chen | F21V 29/713 362/235 |
| 2013/0107538 | A1* | 5/2013 | Lee | F21V 29/89 362/294 |
| 2013/0201700 | A1* | 8/2013 | Tamura | F21V 23/006 362/382 |
| 2013/0271998 | A1* | 10/2013 | Merschon | F21V 17/002 362/294 |
| 2013/0320365 | A1* | 12/2013 | Breidenassel | F21V 3/02 257/88 |
| 2014/0218931 | A1* | 8/2014 | Desilva | F21V 29/773 362/294 |
| 2016/0341368 | A1* | 11/2016 | ChEN | F21K 9/238 |

OTHER PUBLICATIONS

Alibaba.com, SANSI Widely Use E26/E27 8W 9W 13W 22W 27W 5000K LED Bulb for Home Good Quality LED Bulb Lights, date unknown, publisher Alibaba.com (Year: NA).*

* cited by examiner

LED LAMP WITH OMNIDIRECTIONAL HEAT DISSIPATION

CROSS REFERENCE TO RELATED APPLICATION

The present application is related to and claims the benefit of priority to a Chinese Patent Application No. 202010865304X filed on Aug. 25, 2020, and a Chinese Patent Application No. 2020217948445 filed on Aug. 25, 2020, the contents of both applications hereby being incorporated by reference in their entireties for all purposes.

BACKGROUND

Field of Disclosure

The present disclosure relates to the technical field of LED lamps, in particular to an LED lamp with omnidirectional heat dissipation.

Description of Related Arts

The ambient temperature inside the enclosed power supply cavity of traditional LED lamps is as high as 40-60° C., the power supply device works under high ambient temperature conditions for a long time, and its life span will be greatly shortened. Therefore, how to modify the structure of the traditional LED lamps to cool the ambient temperature inside the power supply cavity so as to increase the service life of the LED lamps has become a technical problem to be solved by those skilled in the art.

SUMMARY OF THE PRESENT DISCLOSURE

The present disclosure proposes an LED lamp with omnidirectional heat dissipation to solve the technical problem of excessively high ambient temperature inside the power supply cavity of the traditional LED lamp.

The present disclosure proposes an LED lamp with omnidirectional heat dissipation, including an LED lamp housing and a heat sink. The LED lamp housing includes a power supply component inside. The heat sink supports an LED chip. The LED lamp housing and the heat sink are separated by a heat insulation member to block thermal influence between the LED lamp housing and the heat sink.

In some embodiments of the present disclosure, the LED lamp housing includes a hollow cavity for heat generated by the power supply component to dissipate outside the lamp through natural convection.

In some embodiments of the present disclosure, the hollow cavity includes a plurality of hollow grids along a periphery surface of the cavity.

In some embodiments of the present disclosure, the LED lamp further includes a translucent cover detachably connected with the LED lamp housing to accommodate the heat sink and the LED chip supported by the heat sink.

In some embodiments of the present disclosure, the translucent cover includes one of a snap member and a snap groove, and the LED lamp housing includes the other of the snap member and the snap groove for snap connection.

In some embodiments of the present disclosure, the heat sink includes a ceramic heat sink.

In some embodiments of the present disclosure, a shape of the heat sink includes a cone shape, a cylindrical shape, a spherical shape, or a cubic shape.

In some embodiments of the present disclosure, an outer surface of the power supply component is coated with a thermally conductive insulating material.

In some embodiments of the present disclosure, the thermally conductive insulating material includes: thermally conductive potting glue, thermally conductive silicone sheet, thermally conductive silicone cloth, alumina ceramic, or one-component silicone.

In some embodiments of the present disclosure, the LED lamp further includes a lamp cap interface, and the lamp cap interface is connected with a housing joint of the LED lamp housing.

In summary, the LED lamp with omnidirectional heat dissipation of the present disclosure has the following beneficial effects: The LED lamp of the present disclosure adds a heat insulation plate between the LED lamp housing for placing the power supply component and the heat sink, to block and weaken the mutual influence between the heat generated by the LED chip and the heat generated by the power supply component. The design adopted by the present disclosure can well improve the problem of excessively high ambient temperature inside the power supply cavity of the traditional LED lamps, effectively avoid damage to the power supply device due to long-term working in a high-temperature environment, and improve the service life of the LED lamp.

DETAILED DESCRIPTION OF THE PREFERRED EMBODIMENTS

Figure 1A:
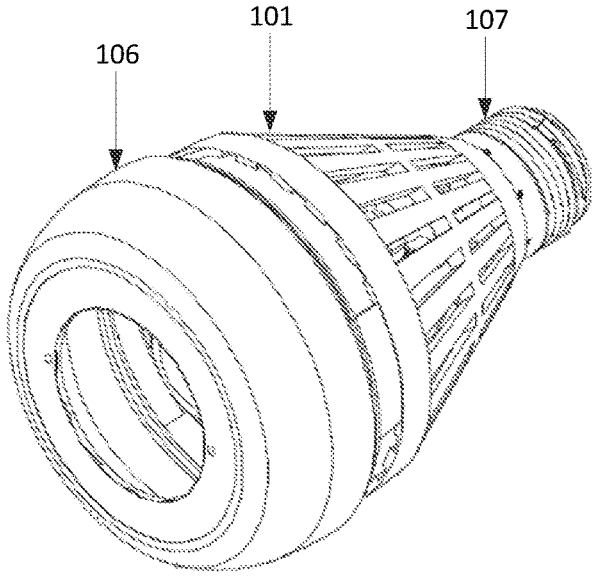
FIG. 1A shows a perspective schematic view of a bulb lamp according to an embodiment of the present disclosure.

The embodiments of the present disclosure will be described below. Those skilled may easily understand other advantages and effects of the present disclosure according to contents disclosed by the specification.

It should be understood that the structures, proportions, sizes, and the like, which are illustrated in the drawings of the present specification, are only used to clarify the contents disclosed in the specification for understanding and reading by those skilled, and are not intended to limit the implementation of the present disclosure, thus are not technically meaningful. Any modification of the structure, change of the scale, or adjustment of the size should still fall within the scope of the technical contents disclosed by the present disclosure without affecting the effects and achievable objectives of the present disclosure. The following detailed description should not be considered limiting, and the scope of the embodiments of the present disclosure is limited only by the claims of the patents. The terms used herein are for describing particular embodiments only, and are not intended to limit the present disclosure. Spatially related terms, such as "upper", "lower", "left", "right", "downward", "below", "bottom", "above", "top", etc., can be used in the text for ease of explanation of the relationship between one element or feature and another element or feature shown in the figure.

In the present disclosure, unless otherwise clearly specified and limited, the terms "install", "connect", "couple", "fix", "hold" and other terms should be understood in a broad sense. For example, it can be a fixed connection, a detachable connection, or an integral connection. It can be a mechanical connection or an electrical connection. It can be a direct connection, or indirect connection through an intermediate medium, or it can be an internal communication between two components. Those of ordinary skill in the art can understand the specific meanings of the above terms in the present disclosure according to specific situations.

In addition, as used herein, the singular forms "a", "an" and "the" are intended to include the plural forms as well, unless the context clearly indicates otherwise. It should be further understood that the terms "comprise", "include" indicate that there are the described features, operations, elements, components, items, categories, and/or groups, but the existence, appearance, or addition of one or more other features, operations, elements, components, items, categories, and/or groups are not excluded. The terms "or" and "and/or" are used herein to be interpreted as inclusive or meaning any one or any combination. Therefore, "A, B or C" or "A, B and/or C" means "any of the following: A; B; C; A and B; A and C; B and C; A, B and C". An exception to this definition occurs only when a combination of elements, functions, or operations are inherently mutually exclusive in some manner.

The ambient temperature inside the enclosed power supply cavity of traditional LED lamps is as high as 40-60° C., the power supply device works under high ambient temperature conditions for a long time, and its life span will be greatly shortened. Therefore, the present disclosure proposes an LED lamp with omnidirectional heat dissipation, which can ensure that the heat generated by the power supply can be quickly dissipated into the air through natural convection under any use state of the lamp. At the same time, the thermal insulation components in the structure can effectively weaken the influence of the heat generated by the LED on the power supply.

It is worth mentioning that the LED lamps in the present disclosure may involve many types, including but not limited to bulb lamps, spot lamps, flood lamps, track lamps, LED fluorescent lamps, LED light bars, tunnel lights, high bay lights, panel lights or underwater lights, etc. To facilitate the understanding of those skilled in the art, a bulb lamp will be taken as an example below, and the technical solutions in the embodiments of the present disclosure will be further described in detail through the following embodiments and the accompanying drawings. It should be understood that the specific embodiments described here are only used to explain the present disclosure, but not used to limit the present disclosure.

Figure 1B:
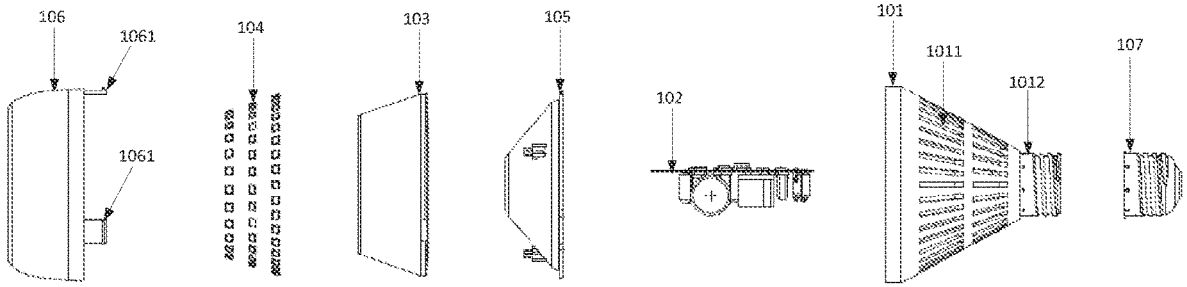
FIG. 1B shows a side exploded view of the bulb lamp according to an embodiment of the present disclosure.
Figure 1C:
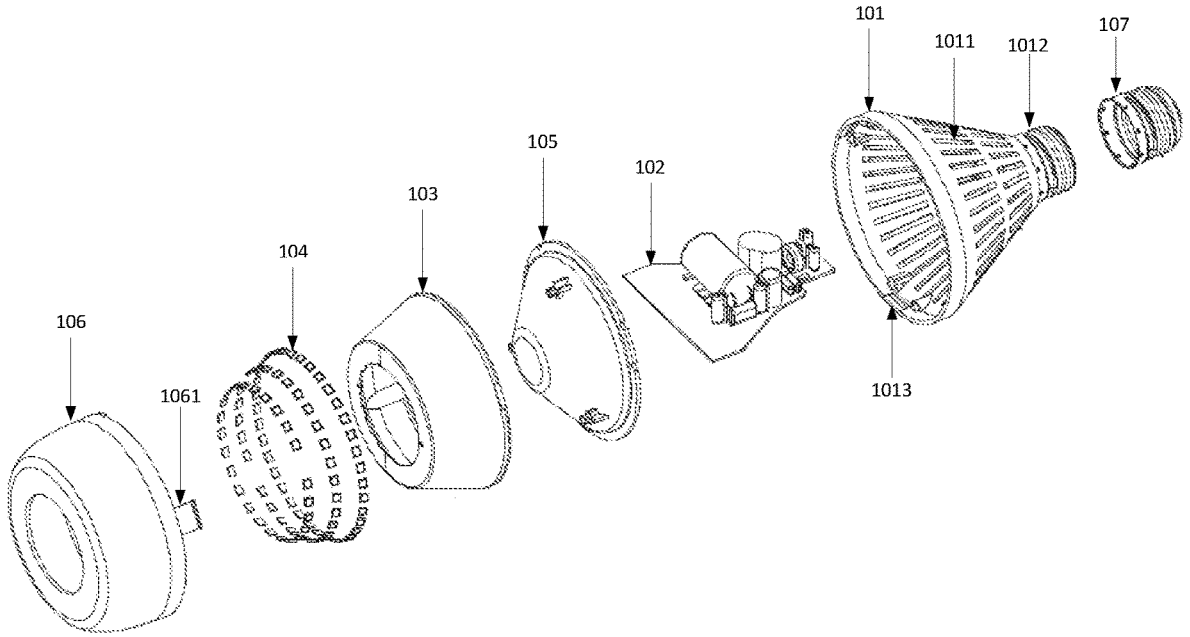
FIG. 1C shows a perspective exploded view of the bulb lamp according to an embodiment of the present disclosure.

FIGS. 1A to 1C show schematic views of a bulb lamp with omnidirectional heat dissipation according to an embodiment of the present disclosure. FIG. 1A shows a perspective schematic view of the bulb lamp; FIG. 1B shows a side exploded view of the bulb lamp; FIG. 1C shows a perspective exploded view of the bulb lamp.

In this embodiment, the bulb lamp with omnidirectional heat dissipation specifically includes an LED lamp housing 101, a power supply component 102, and a heat sink 103. The power supply component 102 is placed in the LED lamp housing 101, and the heat sink 103 supports the LED chip 104 (for example, the LED chip is sticked on the surface of the heat sink). The LED lamp housing 101 and the heat sink 103 are separated by a heat insulation member 105 to block the thermal influence between each other. A material of the thermal insulation member 105 includes plastic, glass fiber, asbestos, rock wool, silicate, vacuum board, aerogel felt, etc., which is not limited in this embodiment.

In some examples, the LED lamp housing 101 includes a hollow cavity, and the hollow cavity includes a plurality of hollow grids 1011 along the peripheral surface of the cavity for the heat generated by the power supply component 102 to dissipate into the outside of the lamp through natural convection. The structure of the LED lamp housing 101 ensures that the heat generated by the power supply component can be quickly dissipated into the air outside the lamp through natural convection under any use state of the lamp. In a preferred implementation manner, the plurality of hollow grids 1011 are evenly arranged along the peripheral surface of the cavity of the LED lamp housing 101, so that the LED lamp can better conduct omnidirectional heat dissipation, and the heat dissipation effect is more ideal and uniform, which avoids local overheating.

Figure 2A:
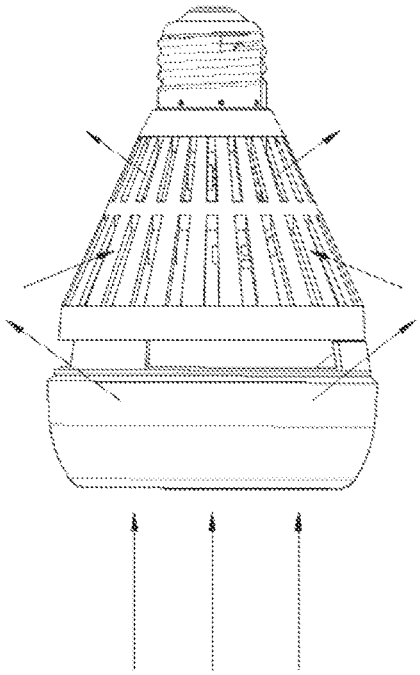
FIG. 2A shows a schematic view of a usage state of the bulb lamp illuminating downward according to an embodiment of the present disclosure.
Figure 2B:
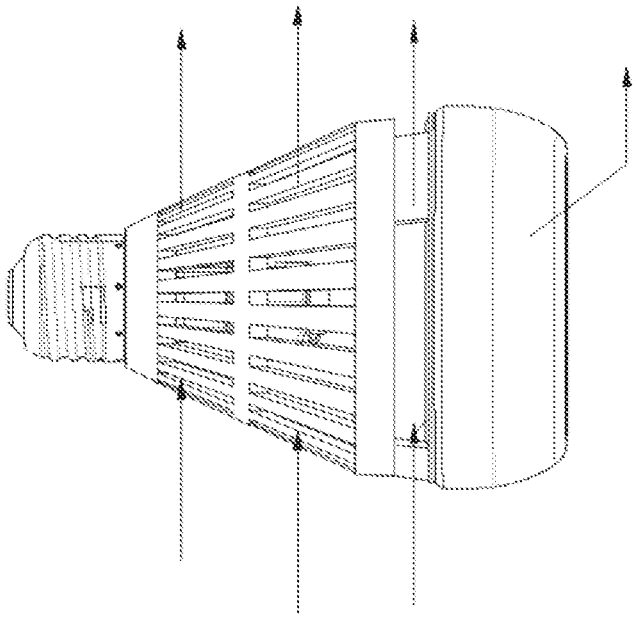
FIG. 2B shows a schematic view of a usage state of the bulb lamp illuminating horizontally according to an embodiment of the present disclosure.
Figure 2C:
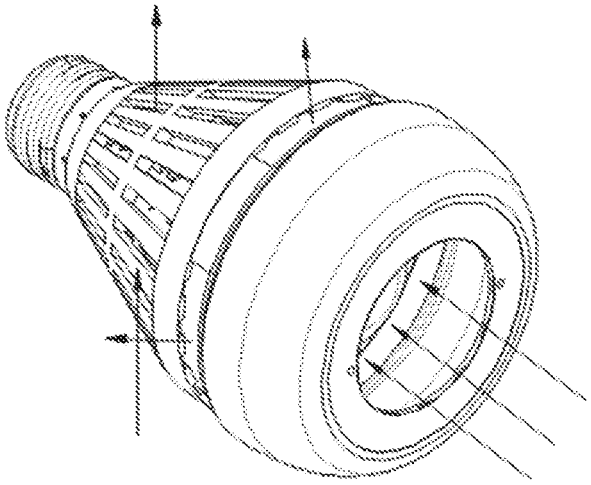
FIG. 2C shows a schematic view of a usage state of the bulb lamp illuminating inclinedly downward according to an embodiment of the present disclosure.
Figure 2D:
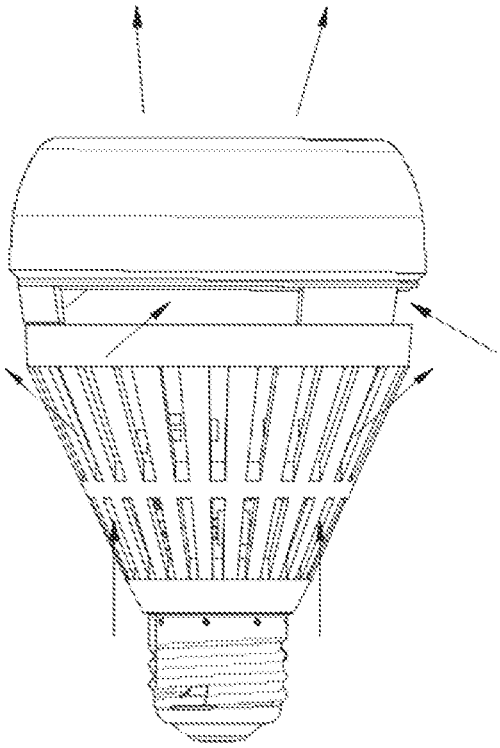
FIG. 2D shows a schematic view of a usage state of the bulb lamp illuminating upward according to an embodiment of the present disclosure.
Figure 2E:
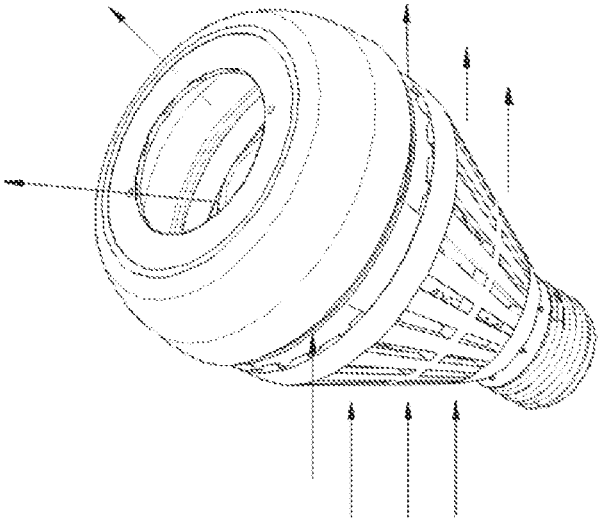
FIG. 2E shows a schematic view of a usage state of the bulb lamp illuminating inclinedly upward according to an embodiment of the present disclosure.

It should be understood that the aforementioned any use state of the lamp mainly includes downward illuminating, horizontal illuminating, oblique downward illuminating, upward illuminating, oblique upward illuminating and other states. Specifically as shown in FIGS. 2A-2E, FIG. 2A shows the downward illuminating state of the lamp, FIG. 2B shows the horizontal illuminating state of the lamp, FIG. 2C shows the oblique downward illuminating state of the lamp, FIG. 2D shows the upward illuminating state of the lamp, and FIG. 2E shows the oblique upward illuminating state of the lamp. The arrows in each figure represent the wind direction. It can be seen from FIGS. 2A-2E that, due to the transparent structure design of the LED lamp housing, the ambient temperature inside the structure is close to the ambient temperature outside the lamp regardless of the use state of the lamp, which can effectively increase the temperature difference between the internal heat source of the lamp and the ambient temperature, and improve the convection efficiency.

Further, the heat sink 103 is preferably a ceramic heat sink. The advantage of using ceramic materials is that ceramics have low thermal resistance and excellent thermal conductivity. Compared with ordinary heat dissipation materials, more compact LED chips can be attached, thereby increasing power density. At the same time, ceramics also have excellent thermal expansion coefficients, which can save Mo sheets in the transition layer, save labor, save materials, reduce costs, reduce solder layer, reduce thermal resistance, reduce voids, and improve yield.

Further, the shape of the heat sink 103 can be correspondingly designed according to actual needs, such as a cone shape, a cylindrical shape, a spherical shape, or even a cubic shape, which is not limited in this embodiment.

In some examples, the bulb lamp with omnidirectional heat dissipation further includes a translucent cover 106, which is detachably connected with the LED lamp housing 101, and is used to accommodate the heat sink 103 and the LED chip 104 carried by it. The heat insulation member 105 is fixed after the LED lamp housing 101 and the translucent cover 106 are assembled. In an optional implementation manner, the translucent cover 106 includes one of a snap member and a snap groove, and the LED lamp housing 101 includes the other of the snap member and the snap groove for snap connection. Taking the structural view shown in FIG. 1B or 1C as an example, the translucent cover 106 includes a plurality of snap members 1061, and the LED lamp housing 101 includes a plurality of snap grooves 1013 corresponding to the number and positions of the snap members 1061, when the snap members 1061 are inserted into the snap grooves 1013, the translucent cover 106 can be connected with the LED lamp housing 101. In addition, the translucent cover 106 and the LED lamp housing 101 can also be connected to each other through screw connection, latching connection, adhesive connection, interference fit connection, etc., which is not limited in this embodiment.

In some examples, the outer surface of the power supply component 102 is coated with a thermally conductive insulating material to meet the power supply heat dissipation and safety requirements. Since the temperature of the power supply component is very high, it will affect the working performance of the bulb lamp or even cause safety hazards. Therefore, in this embodiment, the surface of the power supply component is coated with a thermally conductive insulating material to help the power supply component to dissipate heat. The thermally conductive insulating material can be a thermally conductive potting glue. Because the surface of the power supply component is uneven and irregular, the potting glue can completely wrap the power supply component without moving freely, thereby achieving a good thermal insulation. Thermally conductive silicone sheet can also be used, which has multiple functions such as high thermal conductivity, electrical insulation, and shock and puncture resistance, which can effectively solve safety problems. Thermally conductive silicone cloth can also be used. Usually a layer of silicone grease is applied to the silicone film to increase the fit and reduce the thermal resistance. Alumina ceramics can also be used, which has better thermal conductivity, temperature range and insulation properties. One-component silicone can also be used, which can be applied to the local heat conduction of power supply components, can fix components, and has good adhesion and sealing properties for both metal and non-metal. All of the above thermally conductive insulating materials can be applied to the technical solutions of this embodiment, and the present disclosure is not limited.

In some examples, the bulb lamp with omnidirectional heat dissipation further includes a lamp cap interface 107 connected with the housing joint 1012. Optionally, a snap connection, a latching connection, an interference fit connection, a welding connection, an adhesive connection, etc. can be performed between the lamp cap interface 107 and the housing joint 1012. It should be noted that the size of the lamp cap of the bulb lamp in this embodiment includes, but is not limited to, MR16, GU10, E14, E27, B22, E2, or G24.

In summary, the present disclosure provides an LED lamp with omnidirectional heat dissipation, which adopts an LED lamp housing. The main function of this open-structure is to allow air outside the lamp to enter the inside of the lamp, thereby increasing the temperature difference between the heat source and the ambient temperature, and improving the efficiency of natural convection. At the same time, a heat insulation member is arranged between the LED lamp housing and the heat sink to isolate the heat generated in different parts of the lamp to prevent mutual thermal influence. Therefore, the present disclosure effectively overcomes various shortcomings in the existing technology and has high industrial utilization value.

The above-mentioned embodiments are just used for exemplarily describing the principle and effects of the present disclosure instead of limiting the present disclosure. Those skilled in the art can make modifications or changes to the above-mentioned embodiments without going against the spirit and the range of the present disclosure. Therefore, all equivalent modifications or changes made by those who have common knowledge in the art without departing from the spirit and technical concept disclosed by the present disclosure shall be still covered by the claims of the present disclosure.

We claim:

1. An LED lamp with omnidirectional heat dissipation, comprising:

an LED lamp housing, wherein a power supply component is disposed inside the LED lamp housing, wherein the LED lamp housing comprises a hollow cavity for heat generated by the power supply component to dissipate outside the lamp through natural convection, wherein the hollow cavity includes a plurality of hollow grids along a periphery surface of the hollow cavity, and the plurality of hollow grids communicates with the hollow cavity so that air flows into and out of the hollow cavity through the plurality of hollow grids; and a heat sink, which supports an LED chip;

wherein the LED lamp housing and the heat sink are separated by a heat insulation member to block thermal influence between the LED lamp housing and the heat sink, wherein the heat insulation member is disposed between the heat sink and the power supply component.

2. The LED lamp according to claim 1, wherein the LED lamp further comprises a translucent cover detachably connected with the LED lamp housing to accommodate the heat sink and the LED chip supported by the heat sink.

3. The LED lamp according to claim 2, wherein the translucent cover includes one of a snap member and a snap groove, and the LED lamp housing includes the other of the snap member and the snap groove for snap connection, wherein there are gaps between the translucent cover and the LED lamp housing, the gaps are at least partially defined by the snap member, and the gaps allow air to flow into and out of the translucent cover.

4. The LED lamp according to claim 1, wherein the heat sink comprises a ceramic heat sink.

5. The LED lamp according to claim 1, wherein a shape of the heat sink includes a cone shape, a cylindrical shape, a spherical shape, or a cubic shape.

6. The LED lamp according to claim 1, wherein an outer surface of the power supply component is coated with a thermally conductive insulating material.

7. The LED lamp according to claim 6, wherein the thermally conductive insulating material comprises: thermally conductive potting glue, thermally conductive silicone sheet, thermally conductive silicone cloth, alumina ceramic, or one-component silicone.

8. The LED lamp according to claim 1, wherein the LED lamp further comprises a lamp cap interface, and the lamp cap interface is connected with a housing joint of the LED lamp housing.

* * * * *